US008135318B2

(12) United States Patent
Murao

(10) Patent No.: US 8,135,318 B2
(45) Date of Patent: Mar. 13, 2012

(54) IMAGE FORMING APPARATUS, IMAGE FORMING METHOD, AND SECONDARY TRANSFER UNIT

(75) Inventor: Hidetoshi Murao, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 685 days.

(21) Appl. No.: 12/208,153

(22) Filed: Sep. 10, 2008

(65) Prior Publication Data

US 2009/0067897 A1 Mar. 12, 2009

Related U.S. Application Data

(60) Provisional application No. 60/971,533, filed on Sep. 11, 2007, provisional application No. 60/972,226, filed on Sep. 13, 2007.

(51) Int. Cl.
*G03G 15/20* (2006.01)

(52) U.S. Cl. ..... 399/313; 399/317

(58) Field of Classification Search ..... 399/101, 399/121, 297, 298, 302, 308, 313, 317, 346
See application file for complete search history.

(56) References Cited

U.S. PATENT DOCUMENTS

| | | | | |
|---|---|---|---|---|
| 2,411,761 | A * | 11/1946 | Stolberg | 411/517 |
| 4,253,761 | A * | 3/1981 | Takizawa et al. | 399/357 |
| 5,440,379 | A | 8/1995 | Hayamizu | |
| 2003/0235439 | A1 * | 12/2003 | Nishida et al. | 399/297 |
| 2005/0152722 | A1 * | 7/2005 | Tawada et al. | 399/346 |
| 2005/0232665 | A1 * | 10/2005 | Toshio et al. | 399/346 |
| 2006/0062593 | A1 * | 3/2006 | Takahashi | 399/121 |
| 2007/0231002 | A1 | 10/2007 | Kouzu | |

FOREIGN PATENT DOCUMENTS

JP 2007-264546 10/2007

* cited by examiner

*Primary Examiner* — David Gray
*Assistant Examiner* — Barnabas Fekete
(74) *Attorney, Agent, or Firm* — Patterson & Sheridan, LLP

(57) ABSTRACT

An image forming apparatus includes an image transfer section configured to transfer a reversed image based on a read original image onto an image carrier as a toner image, a secondary transfer roller configured to come into contact with the image carrier and transfer the toner image onto a recording medium, a secondary transfer roller housing section configured to house the secondary transfer roller, a lubricant coating brush configured to come into contact with the secondary transfer roller and coat lubricant on the secondary transfer roller, a lubricant coating brush housing section configured to house the lubricant coating brush and be movable along a groove formed on the secondary transfer roller housing section, a solid lubricant configured to be housed in the lubricant coating brush housing section and supply lubricant to the lubricant coating brush, and a lubricant holding member configured to elastically hold the solid lubricant.

16 Claims, 7 Drawing Sheets

IMAGE FORMING APPARATUS, IMAGE FORMING METHOD, AND SECONDARY TRANSFER UNIT

CROSS-REFERENCE TO RELATED APPLICATION

This application is based upon and claims the benefit of U.S. Provisional Applications No. 60/971,533, filed Sep. 11, 2007 & No. 60/972,226, filed Sep. 13, 2007.

TECHNICAL FIELD

The present invention relates to an image forming apparatus provided with a mechanism for supplying lubricant to a secondary transfer roller and a fur brush and a mechanism for eliminating rattle of a cleaning blade supporting metal plate in a secondary transfer unit having a mechanism for contacting and separating the secondary transfer roller to and from an image carrier.

BACKGROUND

The secondary transfer unit has a contact separation mechanism that contacts the secondary transfer roller to the image carrier when a toner image formed on the image carrier is transferred to a sheet but separates the secondary transfer roller from the image carrier when the toner image formed on the image carrier is not transferred to the sheet.

In a secondary transfer unit having a mechanism for contacting and separating the secondary transfer roller to and from the image carrier, drive apparatuses for contacting and separating the secondary transfer roller have been known that the number of parts of a mechanism section constituting the mechanism for contact and separation operation does not increase and a device such as an electromagnetic clutch requiring electrical control is not used. Such a drive apparatus is disclosed in JP-A-2007-264546.

On the other hand, image forming apparatuses equipped with a mechanism for scrapping off toner remaining on the secondary transfer roller to clean by contacting a cleaning blade to the secondary transfer roller. Moreover, in order to increase a lifetime of the secondary transfer roller and prevent winding of the cleaning blade, a mechanism has been known that coats lubricant on a surface of the secondary transfer roller by using a fur brush. As lubricant, solid zinc stearate is used. The zinc stearate is provided in a holding member, and is pressed by a spring toward a fur brush.

The holding member is formed of a high stiffness member such as a metal plate, and is integrally formed with a zinc stearate.

The zinc stearate is a brittle member which is stiff and frail. Hence, when the zinc stearate is integrally formed with a holding member made of a metal plate and the zinc stearate is attached in a state where the metal plate is greatly bent, a problem that the zinc stearate is cracked is encountered. Therefore, a size of the metal plate should be precisely controlled, and so work becomes complicated.

Furthermore, in order not to buckle and deform a spring for pressing the zinc stearate against the fur brush, it is necessary to caulk a stud in the holding member. Thus, the number of parts increases.

On the other hand, a seal member (side seal) is attached to a secondary transfer roller housing section at each position of both sides of the secondary transfer roller. The secondary transfer roller and the seal member are disposed to be engaged with each other. Thus, toner leakage from the side of the secondary transfer roller is prevented. Furthermore, a gap between the cleaning blade and the side seal is formed as small as possible in consideration of the toner leakage.

The cleaning blade is supported by the blade supporting plate. In this case, gap is generated between the blade supporting plate and the secondary transfer roller housing section by accumulation of tolerance. The blade supporting plate is movable in an axial direction of a supporting shaft in accordance with the gap width.

Since the cleaning blade is movable in front and back directions, the cleaning blade may be overlapped with the side seal. A part of the cleaning blade overlapped with the side seal is lifted by a thickness of the side seal, and thus unevenly comes into contact with the secondary transfer roller at the lifted position. Hence, cleaning error and blade winding are caused. In addition, since a gap is generated between the side seal and the blade end portion on a side opposite to a side overlapping with the side seal, there is concern about toner leakage because of the gap.

Generally, to eliminate gaps, the blade supporting plate is equipped with a plate spring, the plate spring comes into contact with the secondary transfer roller housing section, and thereby the blade supporting plate is disposed close to any one part of the front and the back of the secondary transfer roller housing section. With such a configuration, rattle due to the gap is eliminated. However, since mountability is not so good and a number of flexures are caused, lifetime thereof is short and the total volume of materials is large, and thus cost increases.

SUMMARY

An image forming apparatus according to an aspect of the invention includes an image transfer section transferring a reversed image based on a read original image onto an image carrier as a toner image, and a secondary transfer roller configured to come into contact with the image carrier and transfer the toner image onto a recording medium. Also provided are a contact separation section configured to contact or separate the secondary transfer roller to or from the image carrier, and a secondary transfer roller housing section configured to house the secondary transfer roller. Also provided are a lubricant coating brush configured to come into contact with the secondary transfer roller and coat lubricant on the secondary transfer roller, and a lubricant coating brush housing section configured to house the lubricant coating brush and be movable along a groove formed on the secondary transfer roller housing section. Also provided are a solid lubricant configured to be housed in the lubricant coating brush housing section and supply lubricant to the lubricant coating brush, a lubricant holding member configured to elastically hold the solid lubricant, and an elevating member configured to be formed on a member not interlocking with the secondary transfer roller housing section and elevate the lubricant coating brush housing section.

DETAILED DESCRIPTION

Figure 1:
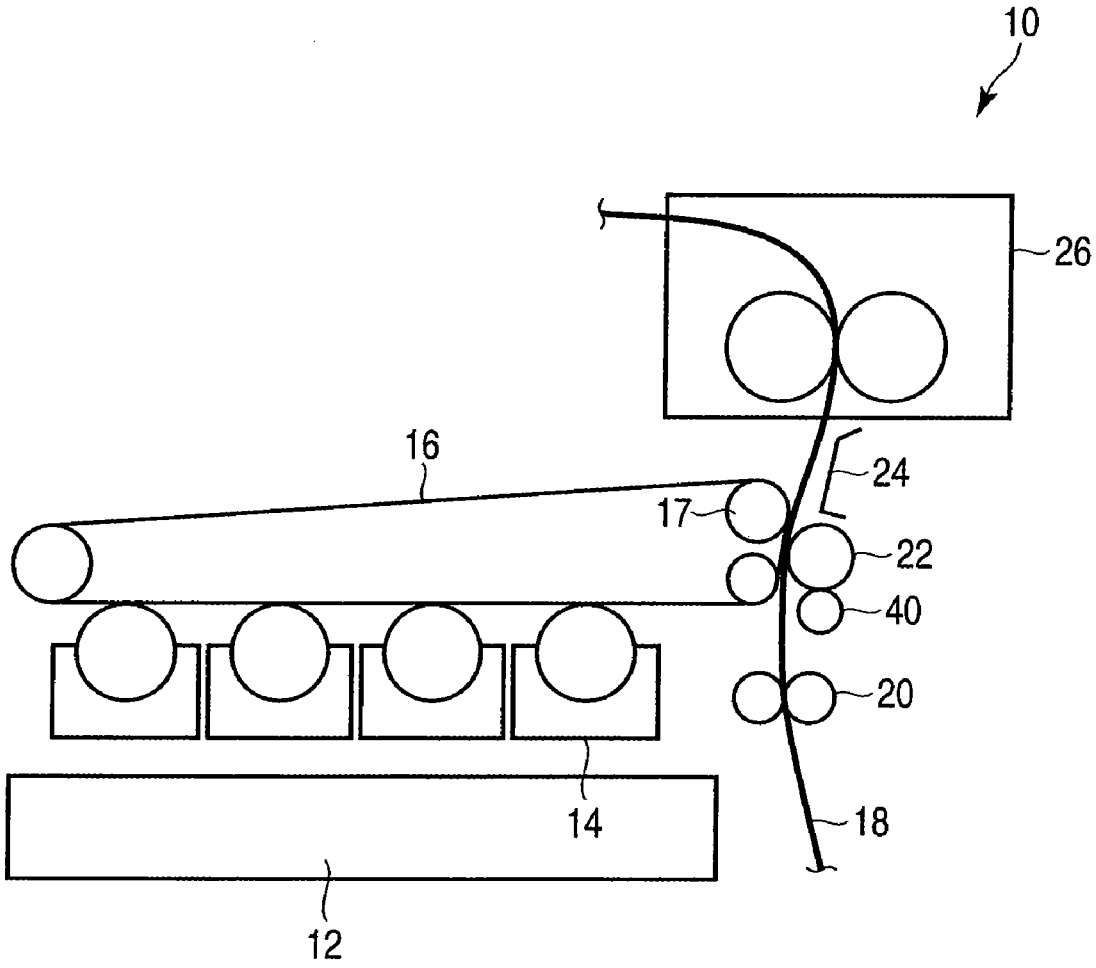
FIG. 1 is a schematic configuration view illustrating an image forming section of an image forming apparatus according to a first embodiment of the invention.
Figure 2:
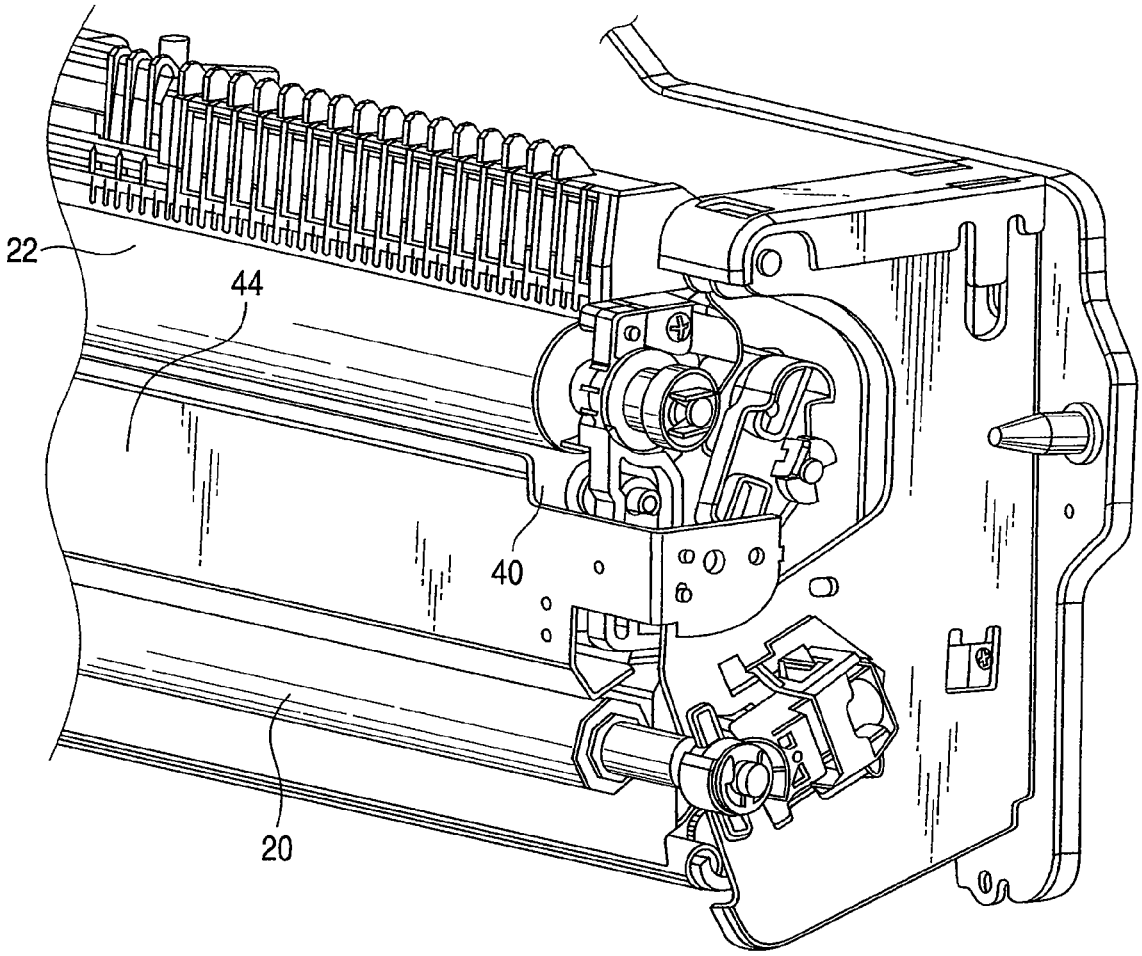
FIG. 2 is a perspective view illustrating a configuration of a secondary transfer unit.
Figure 3:
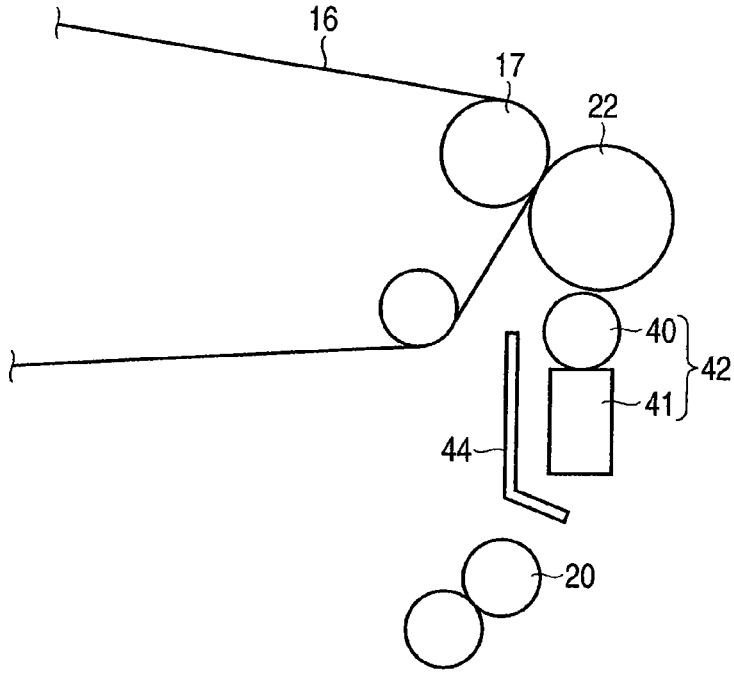
FIG. 3 is a side view illustrating the secondary transfer unit.
Figure 4:
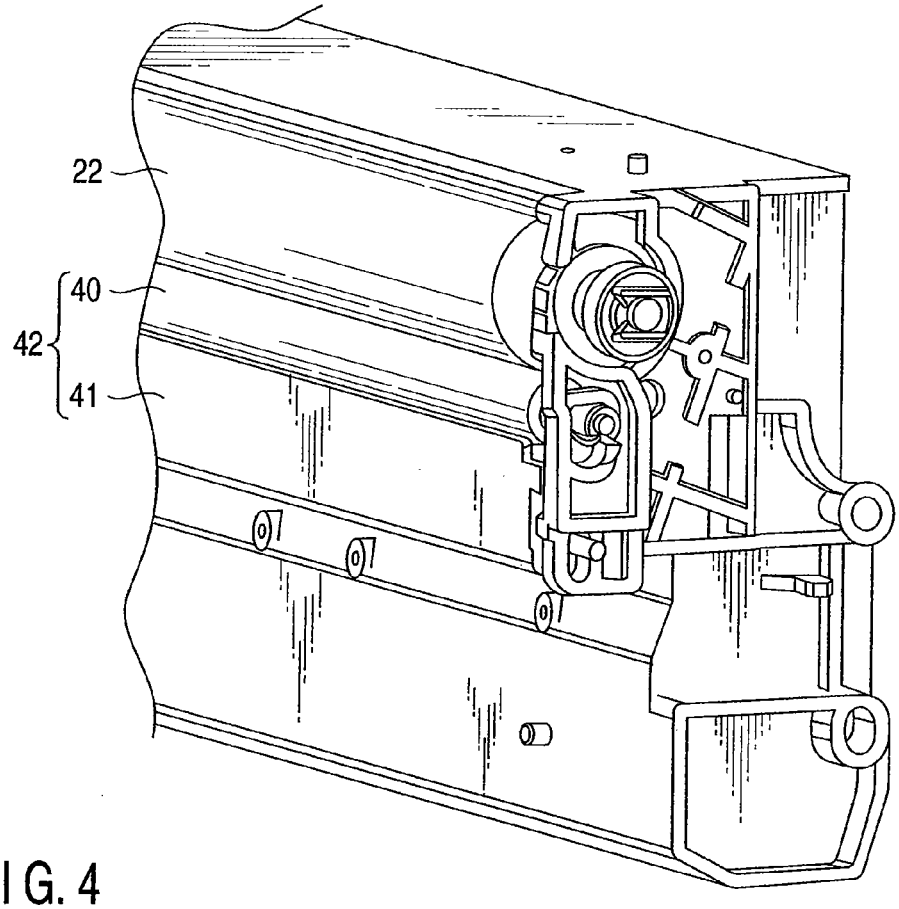
FIG. 4 is a perspective view illustrating a secondary transfer roller and an end portion of a fur brush unit in a state where a pre-transfer guide is removed.

FIG. 1 is a schematic configuration view illustrating an image forming section of an image forming apparatus according to a first embodiment of the invention. FIG. 2 is a perspective view illustrating a configuration of a secondary transfer unit. FIG. 3 is a side view illustrating the secondary transfer unit.

As shown in FIG. 1, an image forming section 10 includes a laser unit 12, a developing unit 14, a transfer belt (image carrier) 16, an opposed roller 17, a sheet conveying path 18, a registration roller 20, a secondary transfer roller 22, a fur brush 40, a conveying guide 24, and a fixer (fixing unit) 26.

The laser unit 12 emits a laser beam optically modulated corresponding to an image signal input from an external device or an image signal of an original document read by a scanner section not shown in the drawings, and forms an electrostatic latent image on the developing unit 14. The developing unit 14 reversely develops the electrostatic latent image, and transfers a toner image onto the transfer belt 16.

The sheet conveying path 18 is a conveying path of a sheet fed from a sheet feeding section not shown in the drawing. The registration roller 20 corrects an inclination of the sheet just before image transfer. The secondary transfer roller 22 is disposed on a downstream of the registration roller 20 to be opposed to the opposed roller 17 and be able to come into contact with the transfer belt 16. The toner image is collectively transferred onto the sheet by passing the sheet between the transfer belt 16 and the secondary transfer roller 22. The conveying guide 24 guides the sheet conveyed from the secondary transfer roller 22 into the fixer 26. The fixer 26 fixes an image transferred by the secondary transfer roller 22 on the sheet.

As shown in FIGS. 2 and 3, on the lower side of the secondary transfer roller 22, a fur brush 40 and a lubricant casing 41 for supplying a lubricant (zinc stearate) to the fur brush 40 by a pressure are disposed. Hereinafter, a unit having the fur brush 40 and the lubricant casing 41 integrally formed thereon is referred to as a fur brush unit 42. Furthermore, a cleaning blade 43 for scraping off the toner remaining on the secondary transfer roller 22 is in contact with the secondary transfer roller 22. In addition, a pre-transfer guide 44 is fixedly disposed between the sheet conveying path 18 and both of the fur brush 40 and the lubricant casing 41.

In the lubricant casing 41, a holding member 70 made of resin and a solid lubricant 60 made of a solidified zinc stearate are housed. The solid lubricant 60 and the holding member 70 are integrally attached to each other by a double faced tape, or the like. On the lower face of the holding member 70, a protruding portion 71 having a protrusion shape is disposed.

The holding member 70 is elastically mounted on a lower face 41*a* of the lubricant casing 41 by a pressing spring 80 disposed around the protruding portion 71. Furthermore, the protruding portion 71 prevents buckle of the pressing spring 80.

In the holding member 70, a load applied to the solid lubricant 60 is set smaller than a shear fracture load of the solid lubricant 60 in a state where the holding member 70 is fully deformed in a component tolerance thereof. Specifically, a bending fracture strength of the solid lubricant 60 is set in the range of 5 to 13 N, and a bending load applied to the solid lubricant 60 in a tolerance of the holding member 70 is set not more than 0.2 N.

Figure 5:
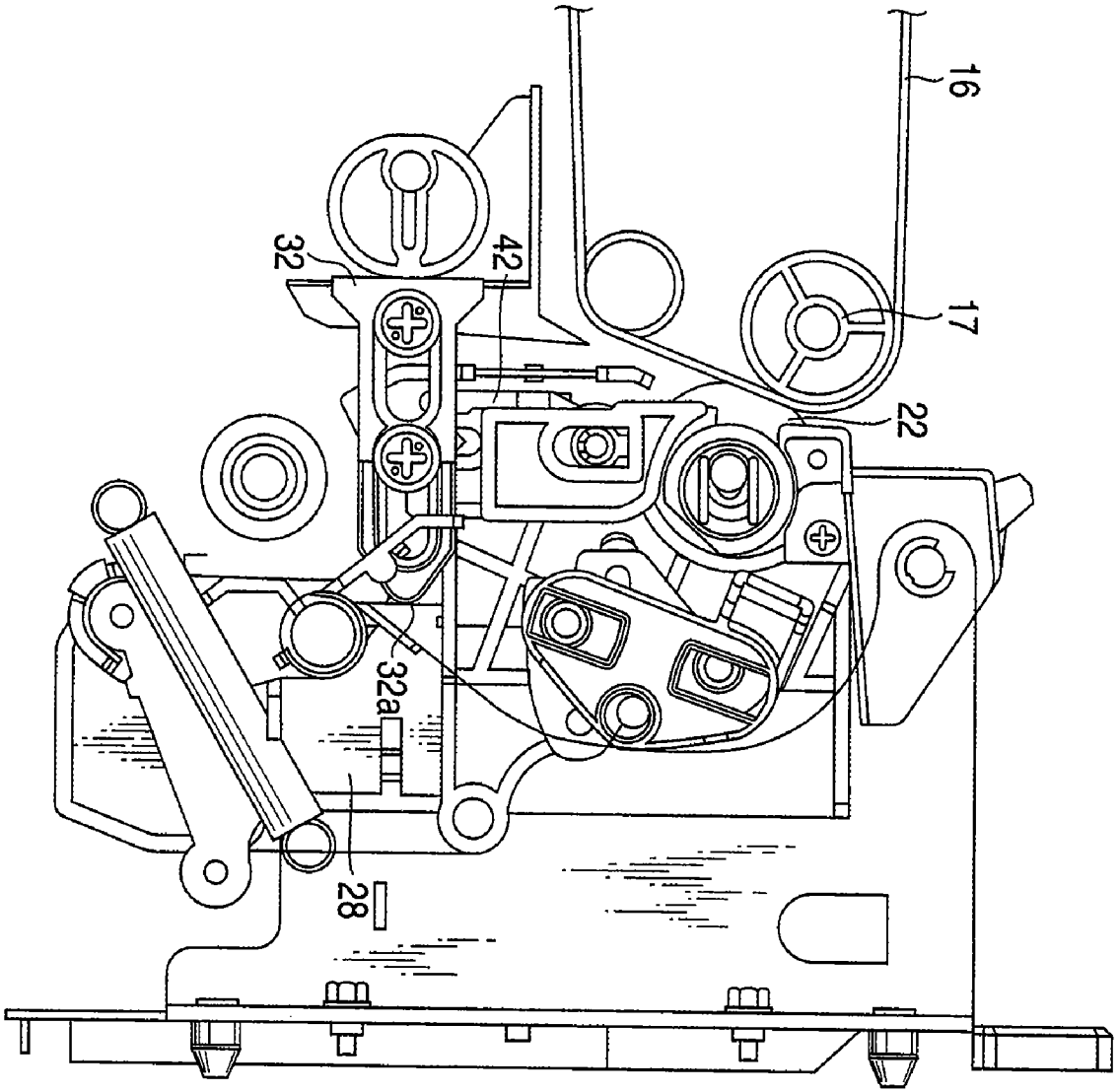
FIG. 5 is an explanatory view explaining contact and separation operations of the secondary transfer roller.
Figure 6:
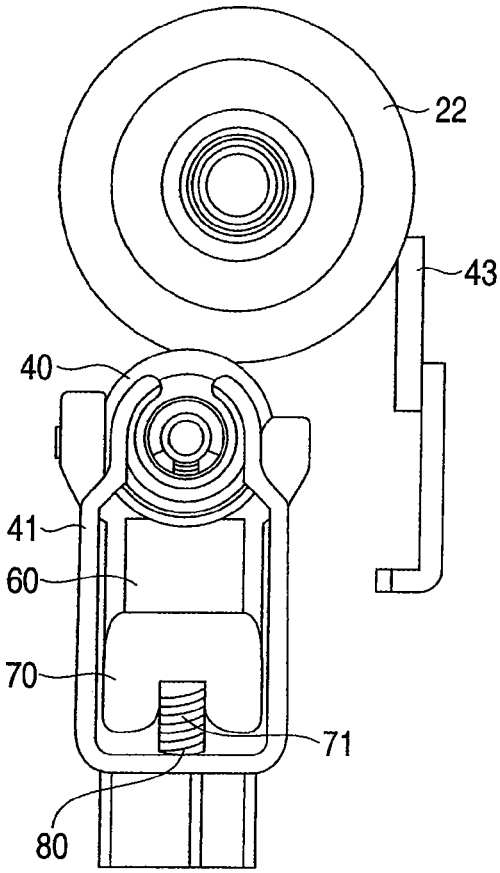
FIG. 6 is a side view illustrating the secondary transfer roller and the fur brush unit.
Figure 7:
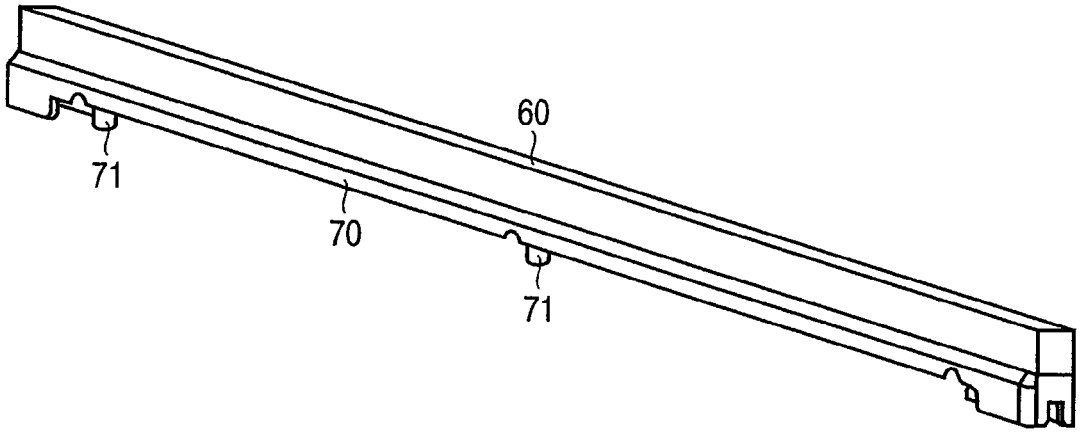
FIG. 7 is a perspective view illustrating a solid lubricant attached to a holding member.

FIG. 5 is an explanatory view explaining contact and separation operations of the secondary transfer roller.

As shown in FIG. 5, both ends of the secondary transfer roller 22 are rotatably supported by a pair of lever shaped members 28 which is a contact separation mechanism. That is, the secondary transfer roller 22 is supported movably between a first position and a second position. Each of the lever shaped members 28 is able to fluctuate about a supporting point which is located on a substantially upper side of the members in a lengthwise direction. Each of the lever shaped members 28 is always biased by an elastic force of a spring not shown in the drawing in a direction in which the secondary transfer roller 22 comes into contact with the transfer belt 16.

Pushers 32 are embedded in the vicinity of lower end portions 28*a* of the lever shaped members 28, respectively. A leading end 32*a* of the pusher 32 is pressed against the lower end portion of the lever shaped member 28, the lever shaped member 28 fluctuates against the elastic force of the spring, and thereby the secondary transfer roller 22 is able to be separated from the transfer belt 16. Meanwhile, by separating the leading end 32*a* of the pusher 32 from the lever shaped member 28, the lever shaped member 28 fluctuates by the elastic force of the spring toward a position in which the secondary transfer roller 22 comes into contact with the transfer belt 16.

According to the embodiment as described above, the solid lubricant 60 pressed by the spring is coated on a surface of the secondary transfer roller 22 by the fur brush 40.

On the other hand, the solid lubricant 60 is made of zinc stearate, and thus is a brittle member which is stiff and frail. Hence, when the holding member made of metal plate is used, the holding member is bent by thermal expansion, and thus there is a concern about crack of the solid lubricant 60. However, when the holding member 70 is made of resin which is an elastic body, the holding member 70 thermally expands together with the solid lubricant 60, and thus it is possible to prevent crack of the solid lubricant 60 accompanied with deformation of the holding member 70.

Furthermore, since the holding member 70 is made of resin, the protruding portion 71 for guiding the pressing spring 80 can be integrally formed therewith. Therefore, it is not necessary to caulk the stud which is needed when the holding member is made of metal plate, and thus it is possible to reduce the number of processes and parts.

Figure 8:
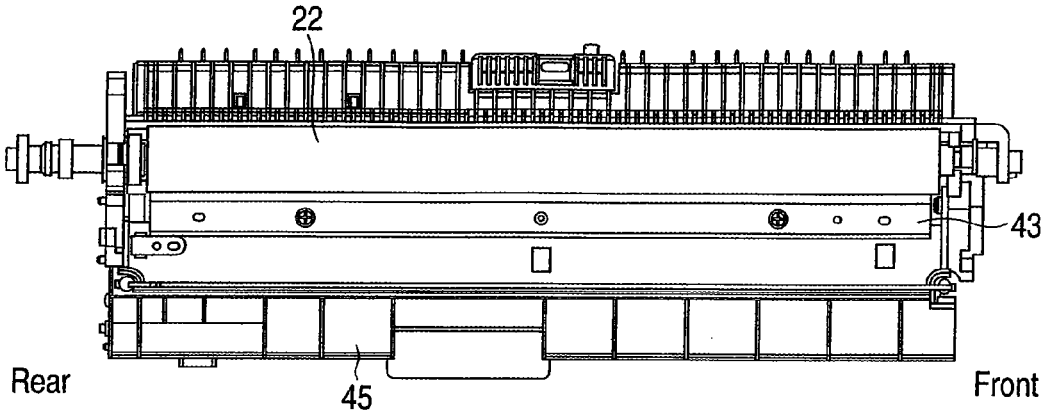
FIG. 8 is a schematic configuration view illustrating an image forming section of an image forming apparatus having a secondary transfer unit built therein according to a second embodiment of the invention.
Figure 9:
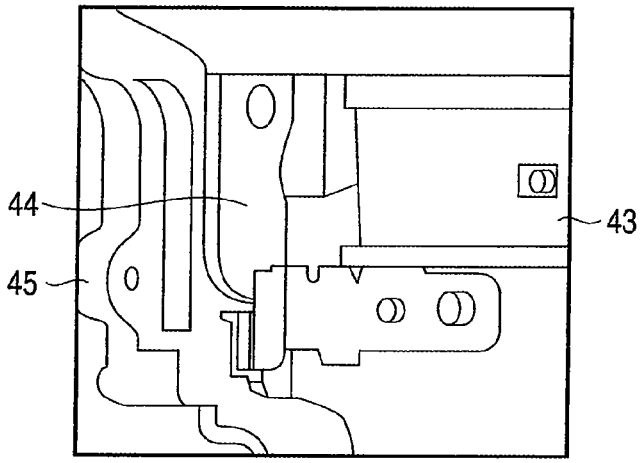
FIG. 9 is a front view illustrating both end sides of a secondary transfer roller.
Figure 10:
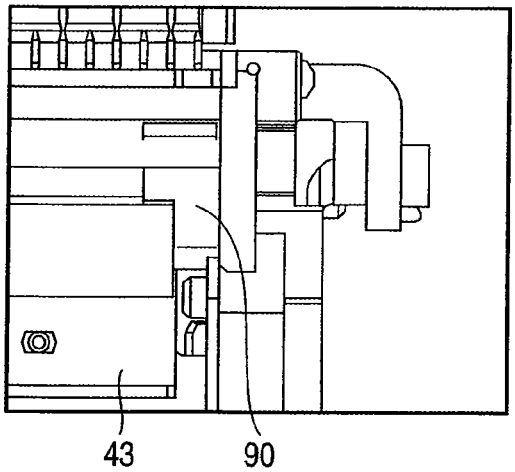
FIG. 10 is a front view illustrating both end sides of a secondary transfer roller.

FIG. 8 is a schematic configuration view illustrating an image forming section of an image forming apparatus having a secondary transfer unit built therein according to a second embodiment of the invention. FIGS. 9 and 10 are front views illustrating both end sides of a secondary transfer roller 22.

Figure 11:
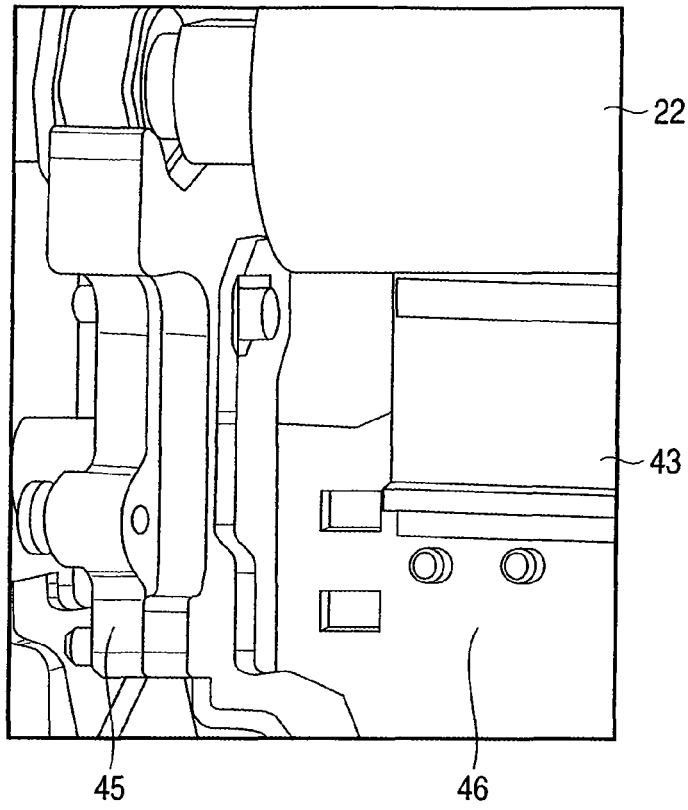
FIG. 11 is a perspective view illustrating a principal part of the secondary transfer unit.
Figure 12:
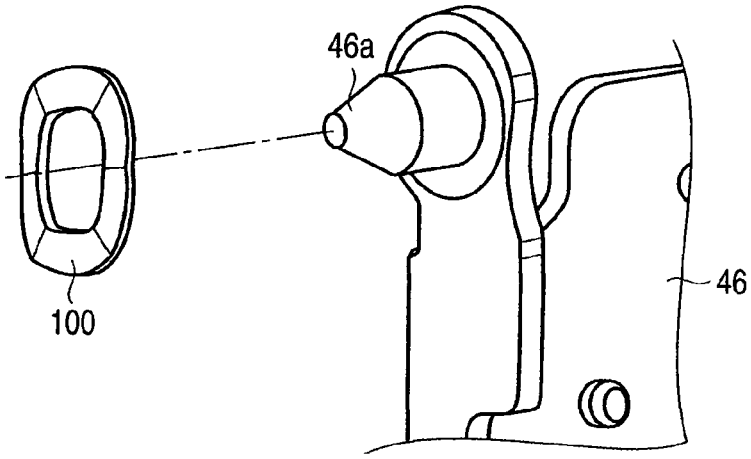
FIG. 12 is a perspective view illustrating a rotation shaft.

FIG. 11 is a perspective view illustrating a principal part of the secondary transfer unit. FIG. 12 is a perspective view illustrating a rotation shaft.

The secondary transfer unit has the secondary transfer roller 22. A shaft bearing of the secondary transfer roller 22 is supported by a secondary-transfer-roller holding casing (secondary transfer roller housing section) 45. Moreover, the secondary-transfer-roller holding casing 45 is provided with the cleaning blade 43 for cleaning toner remaining on the secondary transfer roller 22 by scrapping off the toner and a blade supporting plate 46, on which the cleaning blade 43 is mounted, for pressing the blade on the secondary transfer roller 22.

The blade supporting plate 46 has the rotation shaft 46*a* on the rear side thereof. The plate is supported to freely rotate about a hole of the secondary-transfer-roller holding casing 45 on the rear side.

A side seal (seal member) 90 is attached to the secondary-transfer-roller holding casing 45 at each position of both sides of the secondary transfer roller 33. The secondary transfer roller 22 and the side seal 90 are disposed to be engaged with each other. Thus, toner leakage from the side of the secondary transfer roller is prevented.

By preventing the rattle, the cleaning blade 43 and the side seal 90 are prevented from overlapping with each other. Thus, it is possible to prevent that the cleaning blade 43 is lifted by a thickness of the side seal 90 to unevenly come into contact with the secondary transfer roller 22 at the lifted position. Accordingly, it is possible to prevent cleaning error and blade winding.

Furthermore, a gap is not generated between the side seal 90 and the cleaning blade 43 on a side opposite to a side overlapping with the side seal 90, and thus toner leakage is not caused from the gap.

In addition, by using the spring washer 100, it is not necessary to use screws, and thus it is possible to improve mountability and it is also easy to demount parts. Moreover, it is possible to increase a lifetime by decreasing flexure and to reduce cost by decreasing the total volume of the materials.

What is claimed is:

1. An image forming apparatus comprising:

an image transfer section configured to transfer a reversed image based on a read original image onto an image carrier as a toner image;

a secondary transfer roller configured to come into contact with the image carrier and transfer the toner image onto a recording medium;

a contact separation section configured to contact or separate the secondary transfer roller to or from the image carrier;

a secondary transfer roller housing section configured to house the secondary transfer roller;

a cleaning blade configured to clean the secondary transfer roller by scraping off toner remaining thereon;

a blade supporting plate configured to support the cleaning blade and press the cleaning blade against the secondary transfer roller;

a rotation shaft formed on a rear side of the blade supporting plate, and configured to rotatably support the blade supporting plate on the secondary transfer roller housing section;

a spring washer into which the rotation shaft is inserted, the spring washer configured to press the blade supporting plate;

a lubricant coating brush configured to come into contact with the secondary transfer roller at a position after the cleaning blade and before the image carrier, relative to a rotating direction of the secondary transfer roller, and to coat lubricant on the secondary transfer roller;

a lubricant coating brush housing section configured to house the lubricant coating brush and be movable along a groove formed on the secondary transfer roller housing section;

a solid lubricant configured to be housed in the lubricant coating brush housing section and supply lubricant to the lubricant coating brush;

a lubricant holding member configured to elastically hold the solid lubricant; and an elevating member formed on a member not interlocking with the secondary transfer roller housing section and configured to elevate the lubricant coating brush housing section.

2. The apparatus according to claim 1, wherein in the lubricant holding member, a load applied to the solid lubricant is set smaller than a shear fracture load of the solid lubricant in a state where the lubricant holding member is fully deformed in a component tolerance thereof.

3. The apparatus according to claim 1, wherein the lubricant holding member is elastically mounted on the lubricant coating brush housing section by a pressing spring.

4. The apparatus according to claim 3, wherein the pressing spring is mounted on a protruding portion formed on the bottom surface of the lubricant coating brush housing section to protrude to the lubricant holding member side.

5. The apparatus according to claim 1, wherein the solid lubricant and the lubricant holding member are fixed to each other by a double faced tape.

6. The apparatus according to claim 1, wherein a bending load applied to the solid lubricant in a tolerance of the lubricant holding member is not more than 0.2 N.

7. The apparatus according to claim 1, wherein a bending fracture strength of the solid lubricant is in the range of 5 to 13 N.

8. The apparatus according to claim 1, wherein the lubricant holding member is made of resin.

9. The apparatus according to claim 1, wherein the solid lubricant is made of zinc stearate.

10. The apparatus according to claim 1, wherein the rotation shaft is rotatably supported by being inserted into a hole formed on the secondary transfer roller housing section.

11. The apparatus according to claim 1, wherein a side seal member is formed adjacent to both sides of the cleaning blade in an axial direction of the secondary transfer roller.

12. An image forming method of an image forming apparatus including an image transfer section configured to transfer a reversed image based on a read original image onto an image carrier as a toner image, a secondary transfer roller configured to come into contact with the image carrier and transfer the toner image onto a recording medium and housed in a secondary transfer roller housing section, and a contact separation section configured to contact or separate the secondary transfer roller to or from the image carrier, the method comprising:

pressing a cleaning blade against the secondary transfer roller with a plate that supports the cleaning blade, the plate being rotatably supported on the secondary transfer housing section with a rotation shaft and pressed with a spring washer mounted on the rotation shaft;

cleaning the secondary transfer roller by scraping off toner remaining thereon with the cleaning blade;

contacting the secondary transfer roller with a lubricant coating brush at a position after the cleaning blade and before the image carrier, relative to a rotating direction of the secondary transfer roller;

coating a solid lubricant on the secondary transfer roller with the lubricant coating brush housed in a lubricant coating brush housing section, the lubricant coating brush housing section housing the solid lubricant and being movable along a groove formed on the secondary transfer roller housing section;

elevating the lubricant coating brush housing section with an elevating member formed on a member not interlocked with the secondary transfer roller housing section; and supplying the solid lubricant to the lubricant coating brush by contacting the solid lubricant thereto.

13. The method according to claim 12, wherein the solid lubricant that is coated on the secondary transfer roller is elastically held by a lubricant holding member.

14. The method according to claim 12, wherein the solid lubricant that is coated on the secondary transfer roller is elastically held by a lubricant holding member, and wherein the method further comprises: setting a load applied to the solid lubricant to be smaller than a shear fracture load of the solid lubricant in a state where the lubricant holding member is fully deformed in a component tolerance thereof.

15. The method according to claim 14, wherein the lubricant holding member is elastically mounted on the lubricant coating brush housing section with a pressing spring.

16. The method according to claim 14, wherein the pressing spring is mounted on a protruding portion formed on a bottom surface of the lubricant coating brush housing section.

* * * * *